US006691674B2

(12) United States Patent
McCarthy et al.

(10) Patent No.: US 6,691,674 B2
(45) Date of Patent: Feb. 17, 2004

(54) LATCHED RESET MECHANISM FOR ENGINE BRAKE

(75) Inventors: Donald J. McCarthy, Wethersfield, CT (US); Samuel H. Pruden, East Hartford, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 10/167,664

(22) Filed: Jun. 13, 2002

(65) Prior Publication Data

US 2003/0024501 A1 Feb. 6, 2003

Related U.S. Application Data

(60) Provisional application No. 60/297,449, filed on Jun. 13, 2001.

(51) Int. Cl.[7] ..... F02D 13/04
(52) U.S. Cl. ..... 123/321; 123/90.16; 123/90.17
(58) Field of Search ..... 123/321, 90.12, 123/90.15, 90.16, 90.17, 90.39, 90.46

(56) References Cited

U.S. PATENT DOCUMENTS

| | | | | |
|---|---|---|---|---|
| 3,220,392 A | | 11/1965 | Cummins | |
| 3,786,792 A | | 1/1974 | Pelizzoni et al. | |
| 3,809,033 A | | 5/1974 | Cartledge | |
| 5,146,890 A | | 9/1992 | Gobert et al. | |
| 5,495,838 A | | 3/1996 | Johnson, Jr. | |
| 5,507,261 A | | 4/1996 | Johnson, Jr. | |
| 5,564,385 A | | 10/1996 | Hakansson | |
| 5,586,531 A | | 12/1996 | Vittorio | |
| 5,609,133 A | | 3/1997 | Hakansson | |
| 5,626,116 A | | 5/1997 | Reedy et al. | |
| 5,680,841 A | | 10/1997 | Hu | |
| 5,890,469 A | | 4/1999 | Hakansson et al. | |
| 5,975,251 A | | 11/1999 | McCarthy | |
| 6,000,374 A | | 12/1999 | Cosma et al. | |
| 6,244,257 B1 | * | 6/2001 | Hu | 123/568.14 |
| 6,253,730 B1 | * | 7/2001 | Gustafson | 123/321 |
| 6,354,254 B1 | * | 3/2002 | Usko | 123/90.16 |
| 6,422,186 B1 | | 7/2002 | Vanderpoel | |
| 6,439,195 B1 | * | 8/2002 | Warner | 123/321 |
| 6,450,144 B2 | * | 9/2002 | Janak et al. | 123/321 |

* cited by examiner

*Primary Examiner*—Henry C. Yuen
*Assistant Examiner*—Hai H. Huynh
(74) *Attorney, Agent, or Firm*—Collier Shannon Scott, PLLC; David R. Yohannan

(57) ABSTRACT

A method and rocker arm assembly for actuating an engine valve are disclosed. The rocker arm may include an integrated hydraulic circuit used to control a lost motion piston. A reset piston may be included in the rocker arm to selectively reset the position of the lost motion piston. A control piston may also be included in the rocker arm to selectively lock the reset piston into a reset position. The rocker arm assembly may be used to achieve compression-release or bleeder braking, main intake, main exhaust, brake gas recirculation, and/or exhaust gas recirculation valve events.

26 Claims, 3 Drawing Sheets

LATCHED RESET MECHANISM FOR ENGINE BRAKE

CROSS REFERENCE TO RELATED PATENT APPLICATION

This application claims priority on U.S. Provisional Patent Application Serial No. 60/297,449, for Latched Reset Mechanism for Engine Brake, filed on Jun. 13, 2001.

FIELD OF THE INVENTION

The present invention relates generally to an internal combustion engine rocker arm for controlling engine valves during positive power and engine braking. In particular, the present invention is directed to a rocker arm having a lost motion piston integrated into the rocker arm assembly.

BACKGROUND OF THE INVENTION

Various embodiments of the present invention may have particular use in connection with a compression-release engine retarder for an internal combustion engine. Engine retarders of the compression release-type are designed to convert, at least temporarily, an internal combustion engine of compression-ignition type into an air compressor. In doing so, the engine develops retarding horsepower to help slow the vehicle down. This can provide the operator increased control over the vehicle and substantially reduce wear on the service brakes of the vehicle. A properly designed and adjusted compression release-type engine retarder can develop retarding horsepower that is a substantial portion of the operating horsepower developed by the engine in positive power.

The basic design for a compression release engine retarding system of the type involved with this invention is disclosed in Cummins, U.S. Pat. No. 3,220,392, issued November 1965. The compression release-type engine retarder disclosed in the Cummins '392 patent employs a hydraulic system or linkage. The hydraulic linkage of a typical compression release-type engine retarder may be linked to the valve train of the engine. When the engine is under positive power, the hydraulic linkage may be disabled from providing valve actuation. When compression release-type retarding is desired, the hydraulic linkage is enabled such that valve actuation is provided by the hydraulic linkage responsive to an input from the valve train.

Among the hydraulic linkages that have been employed to control valve actuation (both in braking and positive power), are so-called "lost-motion" systems. Lost-motion, per se, is not new. It has been known that lost-motion systems are useful for valve control for internal combustion engines for decades. In general, lost-motion systems work by modifying the hydraulic or mechanical circuit connecting the actuator (typically the cam shaft) and the valve stem to change the length of that circuit and lose a portion or all of the cam actuated motion that would otherwise be delivered to the valve stem to actuate a valve opening event. In this way lost-motion systems may be used to vary valve event timing, duration, and the valve lift.

In conventional compression-release retarding or braking systems, the system is a bolt-on accessory that fits above the overhead. In order to provide space for mounting the braking system, a spacer may be positioned between the cylinder head and the valve cover which is bolted to the spacer. This arrangement may add unnecessary height, weight, and costs to the engine. Many of the above-noted problems result from viewing the braking system as an accessory to the engine rather than as part of the engine itself.

As the market for compression release-type engine retarders has developed and matured, manufacturers of these retarders have been requested to design systems that secure higher retarding horsepower; increase the air mass delivered to the engine cylinders for the compression-release event; reduce the weight, size and cost of such retarding systems; and improve the inter-relation of various collateral or ancillary equipment, such as silencers, turbochargers and exhaust brakes with the retarding system. In addition, the market for compression release engine retarders has moved from the after-market, to original equipment manufacturers. Engine manufacturers have shown an increased willingness to make design modifications to their engines that would increase the performance and reliability and broaden the operating parameters of the compression release-type engine retarder.

One possible answer to engine manufacturers' demands has been to integrate components of the braking system into existing engine components. One attempt at integrating parts of the compression braking system into the engine is found in U.S. Pat. No. 3,367,312 to Jonsson, which discloses an engine braking system including a rocker arm having a plunger, or slave piston, positioned in a cylinder integrally formed in one end of the rocker arm wherein the plunger can be locked in an outer position by hydraulic pressure to permit braking system operation. Jonsson also discloses a spring for biasing the plunger outward from the cylinder into continuous contact with the exhaust valve to permit the cam-actuated rocker lever to operate the exhaust valve in both the power and braking modes. In addition, a control valve is used to control the flow of pressurized fluid to the rocker arm cylinder so as to permit selective switching between braking operation and normal power operation. However, the control valve unit is positioned separately from the rocker arm assembly, resulting in unnecessarily long fluid delivery passages and a longer response time. This also leads to an unnecessarily large amount of oil that must be compressed before activation of the braking system can occur, resulting in less control over the timing of the compression braking event.

Consequently, there is a need for a simple, yet effective braking system which incorporates the control valve for a lost motion piston integrated into a rocker arm. The integration of the control valve into the rocker arm assembly shortens the hydraulic passages used, improves response time, and may improve compliance.

Another problem facing engine brake manufacturers arises from the use of a unitary cam to drive a rocker for both main event and braking events. Use of a unitary cam may present a significant risk of valve-to-piston contact. Use of a unitary cam for both events, such as is disclosed in U.S. Pat. No. 3,809,033 to Cartledge, means that the extension of the lost motion piston required for the engine braking event will be added to the relatively large main exhaust lobe motion. Because the lash between the lost motion piston must be eliminated to carry out the braking event, the main valve event motion may produce a greater than desired main exhaust event during engine braking, potentially causing valve to piston contact.

Accordingly, there is a need for a system and method that avoids the occurrence of valve-to-piston contact when a unitary cam lobe is used to impart the valve motion for both a compression release event and a main exhaust valve event. More particularly, there is a need for a system and method of limiting the stroke or displacement of a lost motion piston when a lost motion system is imparted with the motion from a main exhaust cam lobe.

One way of avoiding valve-to-piston contact as a result of using a unitary cam for both compression release valve events and main valve events is to limit the motion of the lost motion piston which is responsible for pushing the valve into the cylinder during compression release braking. A device that may be used to limit slave piston motion is disclosed in U.S. Pat. No. 4,399,787 to Cavanagh. Another device that may be used to limit slave piston motion is disclosed in U.S. Pat. No. 5,201,290 to Hu. Both of these (reset valves and clip valves) may comprise means for blocking a passage in a lost motion piston during the downward movement of the lost motion piston.

Thus there is a need for a compression release-type braking system that both integrates the lost motion system into the engine rocker arm and includes a means for resetting or clipping the motion of the lost motion piston that is incorporated into the rocker arm.

It is also desirable to combine multiple profiles, bumps, or lobes on a single cam, e.g., a positive power or main event exhaust valve bump or motion, an engine brake bump or motion, a brake gas recirculation (BGR) bump or motion, and/or an exhaust gas recirculation (EGR) bump or motion. When this is done there must be a mechanism to select which profile(s)/bump(s) are to be active. Improved operation can be obtained if the main event motion is not altered by the addition of other motions.

Thus there is a need for an engine braking system that integrates the lost motion system into the engine rocker arm, includes resetting or clipping capability, and provides for the selection or de-selection of engine braking, BGR, and/or EGR bumps on a unitary cam used to actuate an engine valve.

Therefore, an advantage of some, but not necessarily all embodiments of the present invention is that they may provide a system and method for actuating an engine valve that incorporates a lost motion system into an engine rocker arm.

Additional advantages of embodiments of the present invention are set forth, in part, in the description which follows and, in part, will be apparent to one of ordinary skill in the art from the description and/or from the practice of the invention.

SUMMARY OF THE INVENTION

In response to this challenge, Applicants have developed an innovative rocker arm assembly for actuating an engine valve, said assembly comprising a rocker arm, a hydraulic circuit within the rocker arm, a lost motion piston extending out of the rocker arm and communicating with the hydraulic circuit, a check valve disposed in the hydraulic circuit, a reset piston disposed in the rocker arm and adapted to selectively open the check valve, and a control piston disposed in the rocker arm and adapted to selectively lock the reset piston.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The invention will now be described in conjunction with the following drawings in which like reference numerals designate like elements and wherein.

DETAILED DESCRIPTION OF THE PREFERRED EMBODIMENT

Figure 1:
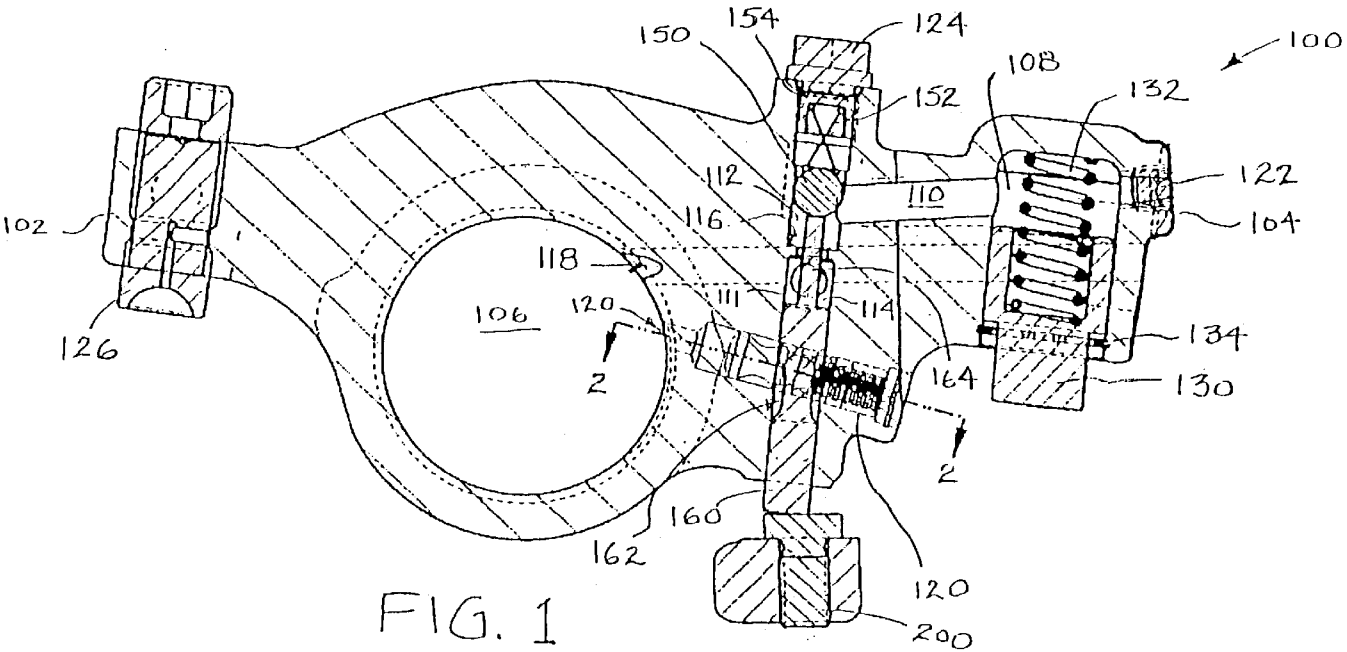
FIG. 1 is a cross sectional side view of a rocker arm assembly in accordance with a first embodiment of the invention when the engine braking system is deactivated.

Reference will now be made in detail to a preferred embodiment of the present invention, an example of which is illustrated in the accompanying drawings. A preferred embodiment of the present invention is shown in FIG. 1 as a cross section of rocker arm assembly 100. The rocker arm assembly 100 includes a first end 102 adapted to receive a member 126 for contacting a motion imparting means such as a cam or push tube (not shown). The member 126 may include internal passages for delivering lubricating oil to the interface between the member 126 and the motion imparting means. The motion imparting means may include a cam having any one or more fixed engine braking (compression release or bleeder), main exhaust or intake, brake gas recirculation (BGR), and/or exhaust gas recirculation (EGR) lobes.

A central opening 106, adapted to receive a rocker shaft (not shown), is provided in the rocker arm 100. A fluid supply passage 118 extends from the central opening 106 to a second end 104 of the rocker arm. A fluid control passage 120 is located below the fluid supply passage 118, and extends from the central opening 106 to an outer surface of the rocker arm 100. The rocker shaft that is inserted into the central opening 106 may itself include hydraulic fluid passages that mate with the fluid supply passage 118 and the fluid control passage 120. As a result, hydraulic fluid may flow between the passages in the rocker shaft and the fluid supply passage 118 and the fluid control passage 120.

Figure 2:
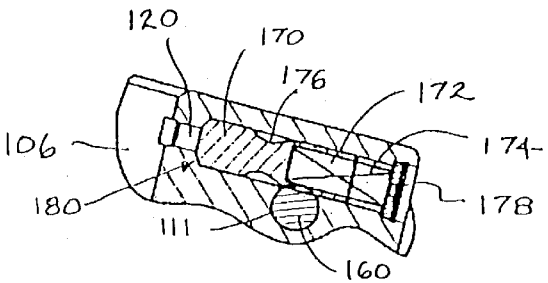
FIG. 2 is a cross sectional view along cut line 2—2 of FIG. 1 of the control piston assembly of the first embodiment of the invention when the engine braking system is deactivated.

With reference to FIG. 2, a control piston 170 may be disposed in the fluid control passage 120. The control piston 170 may include a cavity 172 adapted to receive a control spring 174. The control spring 174 may be positioned between the control piston 170 and a control cap 178 such that the control piston is biased toward the rocker arm central opening 106. The control cap 178 may be designed to substantially prevent fluid in the fluid control passage 120 from leaking out. The control piston 170 may also include a centrally located control neck 176 which is a thinned diameter portion of the control piston. The control neck 176 may be shaped such that it allows a reset piston 160 to slip past it when the control neck 176 is directly adjacent to the reset piston.

With continued reference to FIG. 2, the fluid control passage 120 may be provided with an internal shoulder 180 toward which the control piston 170 may be biased. The control piston 170 is shorter in length than the fluid control passage 120 so that there is room for the control piston to slide back and forth in the control passage, into contact and out of contact with the internal shoulder 180. The control piston 170 should be capable of sliding sufficiently to allow the control neck 176 to align with a reset piston 160.

With renewed reference to FIG. 1, a reset passage 111, having an upper portion 112 and a lower portion 114, extends from the top of the rocker arm 100 to the bottom thereof. The reset passage 111 may be substantially orthogonal to the fluid supply passage 118 and the fluid control passage 120. With reference to FIG. 2, which shows a cross section of a portion of the rocker arm 100 along cut line 2—2 of FIG. 1, it is shown that the reset passage 111 may be laterally offset from the fluid control passage 120 such that the two passages intersect. Although it is not shown in FIG. 2, in the preferred embodiment, the fluid supply passage 118 and reset passage 111 also intersect to a degree required to permit the flow of fluid between the two passages.

A ring-shaped land 116 may extend out of the wall of the reset passage 111 and demark the separation of the reset passage upper portion 112 and the lower portion 114. A check ball 150 may be disposed in the upper portion 112 of the reset passage. The check ball 150 is biased by a check spring 152 toward the land 116. A spring retention cup 154 may center the check spring 152 in the reset passage. A reset cap 124 may be press fit, screwed, or otherwise secured in the upper end of the reset passage 111 so that fluid provided to the upper portion 112 of the reset passage is substantially prevented from escaping from the upper end thereof. Some leakage of fluid past the reset cap 124 may be permitted, or even desired, for lubrication and/or fluid de-aeration purposes.

A reset piston 160 is slidably disposed in the lower portion 114 of the reset passage. The reset piston 160 includes a lower end adapted to contact an external stop 200, an upper end 164 adapted to contact the check ball 150, and a centrally located reset neck 162. The lower end of the reset piston 160 is adapted to provide a seal against the wall of the lower portion 114 of the reset passage. This seal may prevent substantial leakage of fluid out of the lower end of the reset passage 111.

The reset neck 162 may be a portion of the reset piston 160 with a thinned diameter. The reset neck 162 may be adapted to have a curvature that mates with the curvature of the body of the control piston 170. When the reset neck 162 and the control neck 176 are substantially orthogonally aligned, the reset piston 160 and the control piston 170 may slide freely relative to one another. When the reset neck 162 and the control neck 176 are not orthogonally aligned, however, the reset neck 162 may contact the body of the control piston 170 and lock the reset piston 160 into place against the control piston.

With continued reference to FIG. 1, a fluid feed passage 110 connects the upper portion 112 of the reset passage to a chamber 108 located in the second end 104 of the rocker arm. A feed cap 122 may be used to seal the end of the feed passage 110.

A lost motion piston 130 may be slidably disposed in the chamber 108. The lost motion piston 130 may be retained in the chamber 108 by a ring-shaped stop 134. The lost motion piston 130 may be adapted to provide a fluidic seal to the wall of the chamber 108 so as to prevent, or at least limit, fluid leakage from the chamber. The lost motion piston 130 may be provided with an internal cavity adapted to receive a return spring 132. The return spring 132 may bias the lost motion piston 130 toward the stop 134. The lower surface of the lost motion piston 130 is adapted to contact an engine valve (not shown) or a bridge for actuating an engine valve(s).

An external stop 200 may be provided below the rocker arm 100. The external stop 200 may be adjustable in height (e.g., by screwing it into or out of its support).

The operation of the rocker arm assembly 100 to carry out main exhaust and engine braking will now be described. Although the following description refers to use of the rocker arm 100 to operate an exhaust valve(s), it is appreciated that this type of rocker arm may be used for both intake and exhaust valve operation.

During positive power operation of engine, i.e., when engine braking is not desired, hydraulic pressure sufficient to overcome the bias of control spring 174 is not applied to the fluid control passage 120. As a result, the control piston 170 is biased by the control spring 174 into the position shown in FIG. 2. In this position, the control neck 176 is out of alignment with the reset piston 160. As the rocker arm 100 moves to maximum downward displacement under the influence of the main exhaust lobe on the driving cam (as is shown in FIG. 1), the reset piston 160 contacts the external stop 200 and is pushed upward in the reset passage 111. As the reset piston 160 moves upward in the reset passage 111, the reset neck 162 may engage the outer body of the control piston 170 and pull the reset piston up and away from the external stop 200, while at the same time locking the reset piston into a recessed position in the rocker arm 100. Once the reset piston 160 is in this recessed position, it may no longer contact the external stop 200 during the cycling of the rocker arm 100, even when the rocker arm is in its most downward displaced position.

When the reset piston 160 is recessed into the reset passage 111, the upper end 164 of the reset piston may extend into the reset passage upper portion 112 and unseats the check ball 150 upward. The maintenance of the check ball 150 in this unseated position permits free fluid flow between the supply passage 118 and the chamber 108 through the feed passage 110.

The supply passage 118 may communicate with a low pressure hydraulic fluid supply, and optionally with one or more fluid accumulators (not shown). When the check ball 150 is maintained open, the rotation of the rocker arm 100 under the influence of the main exhaust cam lobe causes the lost motion piston 130 to apply pressure to the engine exhaust valve (not shown) below it. The exhaust valve spring(s) exert a greater pressure than that of the hydraulic fluid in the chamber 108. As a result, the downward movement of the rocker arm 100 causes the lost motion piston 130 to be forced upward into the chamber 108 until it contacts the upper end of the chamber. In an alternative embodiment, the upward movement of the lost motion piston 130 may eventually cause the fluid pressure in the chamber 108 to exceed the pressure exerted by the engine valve springs. In either scenario, the movement of the lost motion piston 130 is arrested at some point. After this point, further downward motion of the rocker arm 100 results in the exhaust valve being opened for a main exhaust event. Since the lost motion piston 130 absorbs the initial portion of the main exhaust lobe on the cam, this lobe may have an exaggerated design so that the resulting main exhaust event will have the desired magnitude.

The amount of upward travel that the lost motion piston 130 is designed to provide before it "goes solid" in the chamber 108 is dictated by the size of the engine braking lobe on the driving cam. The travel of the lost motion piston 130 is desirably sufficient to fully absorb the downward movement of the rocker arm 100 by the engine braking cam lobe. Accordingly, in the preferred embodiment of the invention, when the check ball 150 is maintained in its unseated position, the downward rotation of the rocker arm 100 under the influence of the engine braking cam lobe is fully absorbed by the upward travel of the lost motion piston 130.

Figure 4:
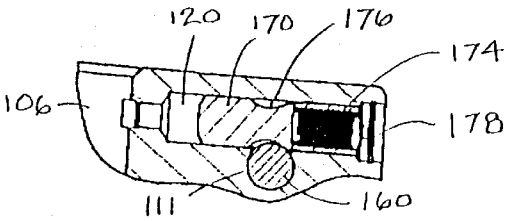
FIG. 4 is a cross sectional view along cut line 4—4 of FIG. 3 of the control piston assembly of the first embodiment of the invention when the engine braking system is activated.
Figure 3:
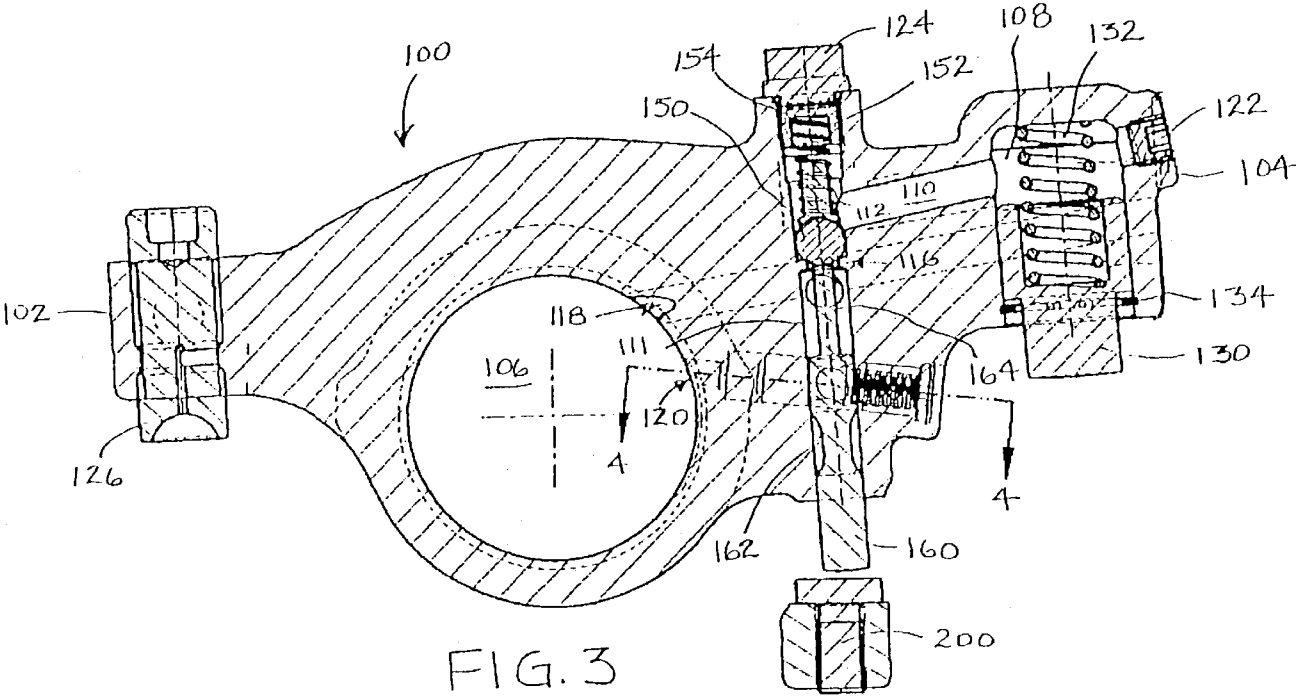
FIG. 3 is a cross sectional side view of a rocker arm assembly in accordance with the first embodiment of the invention when the engine braking system is activated.

With reference to FIGS. 3 and 4, when engine braking operation is desired, a remotely located valve, such as a solenoid valve, may be actuated to supply low pressure hydraulic fluid to the control passage 120. The supply of fluid to control passage 120 may cause the control piston 170 to be forced back into the control passage compressing the control spring 174. The control piston 170 may be forced back until the control neck 176 aligns with the reset piston 160. When the control piston 170 is in this position, the reset piston 160 is unlocked and free to slide up and down in the reset passage 111. As a result, the check spring 152 pushes the check ball 150 downward until it seats against the land 116. The downward movement of the check ball 150 forces the reset piston 160 down through the reset passage so that the lower end of the reset piston extends out from the bottom of the rocker arm 100.

When the reset piston 160 is in its unlocked position, low pressure hydraulic fluid from the supply passage 118 is capable of unseating the check ball 150 slightly, thereby allowing fluid to fill the chamber 108. Once the chamber 108 fills, the lost motion piston 130 is in its most downward position against the ring stop 134. This is the cam base circle position for the rocker arm 100 during engine braking operation.

From the base circle position, the rocker arm 100 may first encounter an engine braking cam lobe. Downward movement of the rocker arm 100 under the influence of the braking cam lobe may cause pressure to be applied to the lost motion piston 130 by the engine valve to be actuated. As the lost motion piston 130 is forced upward toward the chamber 108, the fluid in the chamber 108, the feed passage 110, and the reset passage upper portion 112 may become highly pressurized, thereby forcing the check ball 150 to seat against the land 116. Once the check ball 150 seats, the resulting high pressure circuit prevents the lost motion piston 130 from receding into the chamber 108. Because the lost motion piston 130 is hydraulically locked, the downward motion of the rocker arm 100 opens the engine valve for an engine braking event.

Figure 5:
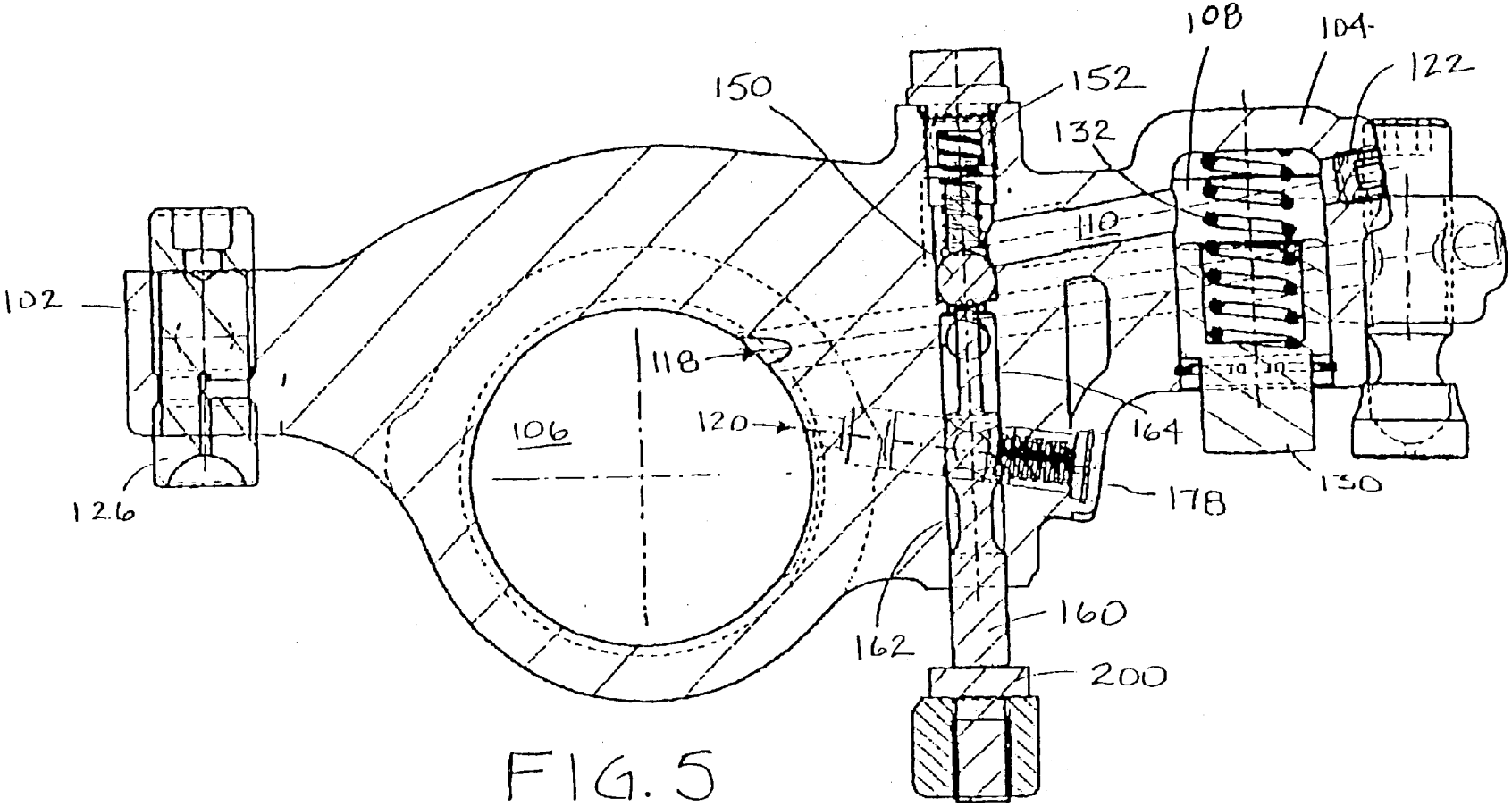
FIG. 5 is a cross sectional side view of a rocker arm assembly in accordance with the first embodiment of the invention when the engine braking system is activated and the lost motion piston is about to be reset.

After the engine braking event, the rocker arm 100 may be displaced downward by a main exhaust event. The main exhaust cam lobe may be larger than the engine braking cam lobe, and the main exhaust event may or may not begin from cam base circle. During engine braking operation, the operation of the rocker arm 100 is substantially the same during the initial portion of the main exhaust event as it is during the engine braking event. As the rocker arm 100 is initially displaced downward under the influence of the main exhaust lobe, the check ball 150 maintains the high pressure circuit in the rocker arm. While the high pressure circuit is maintained, the downward movement of the rocker arm 100 causes the engine valve to be opened. The engine valve is opened more and more until the motion of the rocker arm 100 causes the lower end of the reset piston 160 to contact the external stop 200, as shown in FIG. 5. The point on the main exhaust lobe at which the reset piston 160 contacts the external stop 200 may be adjusted by screwing the stop into or out of its support.

Further motion of the rocker arm 100 may cause the reset piston 160 to be forced upward in the reset passage 111. The upward displacement of the reset piston 160 may unseat the check ball 150. Unseating the check ball 150 allows the high pressure fluid in the chamber 108 and feed passage 110 to flow past the land 116 and into the fluid supply passage 118. The high pressure fluid may be absorbed by the low pressure supply and/or accumulator(s) connected to the supply passage. Relief of the high pressure fluid causes the lost motion piston 130 to move upward in the chamber 108 to absorb the remainder of the motion resulting from the main exhaust lobe. Thus, the release of the high pressure circuit resets the lost motion piston 130. When the cam returns to base circle, the chamber 108 may refill with hydraulic fluid.

Embodiments of the present invention may be used to carry out other types of engine braking, not just compression release braking. For example, selective bleeder braking may be facilitated through use of the rocker arms disclosed and claimed herein. Furthermore, these rocker arms may be used to carry out any auxiliary valve actuation, not just engine braking. For example, the rocker arms disclosed and claimed herein may serve as intake rocker arms and/or exhaust rocker arms to facilitate brake gas recirculation, and/or exhaust gas recirculation. The BGR and EGR functionality may be provided alone or in combination with engine braking.

It will be apparent to those skilled in the art that variations and modifications of the present invention can be made without departing from the scope or spirit of the invention. For example, the reset, control, and lost motion pistons contemplated as being within the scope of the invention may be of any shape or size so long as the elements in combination provide the function of selectively discharging hydraulic fluid from a high pressure circuit to a low pressure circuit responsive to the motion of a rocker arm. Furthermore, it is contemplated that the scope of the invention may extend to variations on the arrangement of the system elements in the rocker arm, as well as variations in the choice of valve train elements (cams, rocker arms, push tubes, etc.) and their interrelation to the rocker arm. It is further contemplated that any hydraulic fluid may be used in the system of the invention. Thus, it is intended that the present invention cover the modifications and variations of the invention, provided they come within the scope of the appended claims and their equivalents.

What is claimed is:

1. A rocker arm assembly for actuating an engine valve, said assembly comprising:

a rocker arm with a central opening;

a hydraulic circuit within said rocker arm;

a lost motion piston extending out of said rocker arm and communicating with said hydraulic circuit;

a check valve disposed in said hydraulic circuit;

a reset piston disposed in said rocker arm and adapted to selectively open said check valve; and a control piston disposed in said rocker arm and adapted to selectively lock said reset piston, wherein the control piston includes a control neck adapted to selectively engage the reset piston.

2. A rocker arm assembly for actuating an engine valve according to claim 1, wherein the hydraulic circuit includes a fluid supply passage extending between a central opening in the rocker arm and a reset passage.

3. A rocker arm assembly for actuating an engine valve according to claim 2, wherein said check valve includes:

a check ball;

a ring shaped land in the reset passage; and a check spring adapted to bias said check ball towards said ring shaped land.

4. A rocker arm assembly for actuating an engine valve according to claim 1, wherein said reset piston includes:

an upper end;

a lower end; and a reset neck between said upper end and said lower end, said reset neck being adapted to selectively engage the control piston.

5. A rocker arm assembly for actuating an engine valve according to claim 4, further comprising an external stop located below the rocker arm, and wherein said reset piston lower end is adapted to selectively contact the external stop.

6. A rocker arm assembly for actuating an engine valve according to claim 4, wherein said reset piston upper end is adapted to selectively open the check valve.

7. A rocker arm assembly for actuating an engine valve according to claim 1, wherein the hydraulic circuit includes a reset passage, said check valve is disposed in an upper portion of the reset passage, and the reset piston is disposed in a lower portion of the reset passage.

8. A rocker arm assembly for actuating an engine valve according to claim 1 further comprising:

a control spring adapted to bias the control piston toward the rocker arm central opening.

9. A rocker arm assembly for actuating an engine valve according to claim 1, further comprising:

a return spring adapted to bias the lost motion piston towards the engine valve.

10. A rocker arm assembly for actuating an engine valve according to claim 1, wherein said lost motion piston is adapted to contact a valve component selected from the group consisting of: an engine valve, and an engine valve bridge.

11. A rocker arm assembly for actuating an engine valve according to claim 1, wherein said hydraulic circuit includes:

a fluid supply passage;

a fluid control passage; and a fluid feed passage.

12. A rocker arm assembly for actuating an engine valve according to claim 1 further comprising a cam operatively connected to the rocker arm, and wherein said cam includes one or more lobes selected from the group consisting of: a compression release lobe, a bleeder brake lobe, a main exhaust lobe, a main intake lobe, a brake gas recirculation lobe, and an exhaust gas recirculation lobe.

13. A rocker arm assembly for actuating an engine valve according to claim 1, wherein said reset piston is disposed in the rocker arm substantially orthogonal to said control piston.

14. A rocker arm assembly for actuating an engine valve according to claim 1, wherein said reset piston is disposed in the rocker arm laterally offset from the control piston.

15. A rocker arm assembly for actuating an engine valve according to claim 14, wherein said reset piston includes:

an upper end;

a lower end; and a reset neck between said upper end and said lower end, said reset neck being adapted to selectively engage the control piston.

16. A method of actuating an engine valve using a rocker arm having an integrated lost motion piston to carry out an auxiliary valve event comprising the steps of:

providing a rocker arm having an integrated lost motion piston, a reset piston, and a hydraulic circuit connecting the lost motion piston to the reset piston;

providing hydraulic fluid to the hydraulic circuit sufficient to place the lost motion piston in an extended position;

actuating the engine valve with the lost motion piston to carry out an auxiliary valve event;

selectively activating the reset piston to release hydraulic fluid from the hydraulic circuit near the conclusion of the auxiliary valve event and thereby reset the lost motion piston; and selectively locking the reset piston into a position that prevents the lost motion piston from being maintained in an extended position by engaging the reset piston with a cylindrical side wall of a control piston extending laterally adjacent to the reset piston.

17. A rocker arm assembly for actuating an engine valve, said assembly comprising:

a rocker arm with a central opening;

a hydraulic circuit within said rocker arm;

a lost motion piston extending out of said rocker arm and communicating with said hydraulic circuit;

a check valve disposed in said hydraulic circuit;

a reset piston disposed in said rocker arm and adapted to selectively open said check valve; and a control piston disposed in said rocker arm and adapted to selectively lock said reset piston, wherein said reset piston is disposed in the rocker arm laterally offset from the control piston.

18. A rocker arm assembly for actuating an engine valve according to claim 17, wherein the hydraulic circuit includes a fluid supply passage extending between a central opening in the rocker arm and a reset passage.

19. A rocker arm assembly for actuating an engine valve according to claim 18, wherein said check valve includes:

a check ball;

a ring shaped land in the reset passage; and a check spring adapted to bias said check ball towards said ring shaped land.

20. A rocker arm assembly for actuating an engine valve according to claim 17, wherein said reset piston includes:

an upper end;

a lower end; and a reset neck between said upper end and said lower end, said reset neck being adapted to selectively engage the control piston.

21. A rocker arm assembly for actuating an engine valve according to claim 20, further comprising an external stop located below the rocker arm, and wherein said reset piston lower end is adapted to selectively contact the external stop.

22. A rocker arm assembly for actuating an engine valve according to claim 20, wherein said reset piston upper end is adapted to selectively open the check valve.

23. A rocker arm assembly for actuating an engine valve according to claim 17, wherein the hydraulic circuit includes a reset passage, said check valve is disposed in an upper portion of the reset passage, and the reset piston is disposed in a lower portion of the reset passage.

24. A rocker arm assembly for actuating an engine valve according to claim 17, further comprising:

a control spring adapted to bias the control piston toward the rocker arm central opening.

25. A rocker arm assembly for actuating an engine valve according to claim 17, wherein said hydraulic circuit includes:

a fluid supply passage;

a fluid control passage; and a fluid feed passage.

26. A rocker arm assembly for actuating an engine valve according to claim 17 further comprising a cam operatively connected to the rocker arm, and wherein said cam includes one or more lobes selected from the group consisting of: a compression release lobe, a bleeder brake lobe, a main exhaust lobe, a main intake lobe, a brake gas recirculation lobe, and an exhaust gas recirculation lobe.

* * * * *